US005495704A

United States Patent [19]

Menayan

[11] Patent Number: 5,495,704

[45] Date of Patent: Mar. 5, 1996

[54] HEAT-SHRINKABLE BAND APPLICATION MACHINE

[76] Inventor: Victor V. Menayan, 103 Rothschild Pl., Cary, N.C. 27511

[21] Appl. No.: 232,774

[22] Filed: Apr. 25, 1994

Related U.S. Application Data

[62] Division of Ser. No. 31,314, Mar. 15, 1993, Pat. No. 5,305,578.

[51] Int. Cl.[6] ..... B65B 9/10

[52] U.S. Cl. ..... 53/399; 53/442; 53/292; 53/585

[58] Field of Search ..... 53/399, 442, 459, 53/291, 292, 567, 585, 557, 313, 315, 316

[56] References Cited

U.S. PATENT DOCUMENTS

| | | | |
|---|---|---|---|
| 2,976,661 | 3/1961 | Bagnelle | 53/585 X |
| 3,888,067 | 6/1975 | Cross et al. | 53/292 |
| 4,184,309 | 1/1980 | Amberg | 53/585 X |
| 4,293,364 | 10/1981 | Fujio | 53/585 X |
| 4,357,788 | 11/1982 | Amberg | 53/585 |
| 4,914,893 | 4/1990 | Strub et al. | 53/585 X |
| 5,070,680 | 12/1991 | Nagano | 53/585 X |
| 5,101,613 | 4/1992 | Wilhelm et al. | 53/292 X |
| 5,305,578 | 4/1994 | Menayan | 53/399 |

*Primary Examiner*—Linda Johnson
*Attorney, Agent, or Firm*—Rhodes, Coats & Bennett

[57] ABSTRACT

A band application machine for transferring to containers heat-shrinkable bands. The band application machine includes a band feed system for feeding band supply material to a cutting system which cuts a band from the band supply. A transfer system transfers cut bands to containers conveyed past a banding point, and includes a band gripping mechanism and a plunger. Band gripping mechanism includes opposed suction cups that are movably mounted for gripping and positioning a cut band. The suction cups are laterally movable from a position where a closed band is gripped on opposing sides by the suction cups to a position where the band is open and aligned with the stroke of the plunger. The plunger is positioned over the opened band at an angle with respect to the band. The plunger presses and drives the band onto a container as the gripper apparatus releases the open band. The angle of the top plunger with respect to the cut band results in the plunger engaging a leading edge of the cut band as the plunger moves to press the band onto the underpassing container. Associated with the plunger are air blast openings that direct air against an inside, trailing section of the band so as to effectively urge and maintain the band in an open position as the plunger presses the band onto the container. A programmable control system directs the operation of the band application machine.

27 Claims, 8 Drawing Sheets

HEAT-SHRINKABLE BAND APPLICATION MACHINE

This application is a divisional of application Ser. No. 08/031,314, filed Mar. 15, 1993, now U.S. Pat. No. 5,305, 578 issued Apr. 26, 1994.

FIELD OF THE INVENTION

The present invention relates to machines for applying heat-shrinkable bands to containers, and more particularly to a method and apparatus for precisely positioning bands onto containers being conveyed past a band application point.

BACKGROUND OF THE INVENTION

One problem faced by engineers and designers of band application machines is that of designing a machine capable of accommodating both small and large diameter bands and bands having depths of various lengths. In particular, a band application machine includes a transfer mechanism capable of repeatedly transferring cut bands to containers passing a band application point. Transfer mechanisms of prior art machines are typically designed to only handle a very limited size range of bands. Thus, versatility and effectiveness of prior art band application machines are severely limited due to their inability to handle a wide range of different size bands. For example, a business needing to place different size bands on containers may have to purchase several band application machines to handle the different sized bands. Likewise, a business with a single type of machine may have to redesign or rework a machine if they decide to apply different size bands to containers.

There is a great need for a versatile machine that can apply a variety of different size bands to containers without the need to rework or redesign the machine.

SUMMARY AND OBJECTS OF THE INVENTION

The present invention has been designed to overcome the problems of prior art banding machines discussed above. More particularly, the band application machine of the present invention includes a transfer mechanism capable of transferring to containers both small and large diameter bands and bands having depths of various lengths.

Briefly reviewing the structure of the present invention, the band application machine of the present invention includes a transfer mechanism having a cut band gripping mechanism. The band gripping mechanism includes suction cups that are movably mounted. The suction cups are laterally moveable from a position where a closed band is gripped on opposing sides to a position where the band is open and laterally aligned with the stroke of a plunger positioned above the band. The ability of the transfer mechanism to grip the band on opposing sides and to laterally position the band enables the machine to handle a wide range of different size bands.

The plunger is positioned over the opened band at an angle with respect to the band. The plunger presses and drives the band onto a container as the band gripping mechanism releases the open band. The angle of the top plunger with respect to the cut band results in the plunger engaging a leading edge of the cut band as the plunger moves to press the band onto the under passing container. Associated with the plunger is an air blast means that directs air against an inner trailing section of the band as the plunger presses the band onto the container so as to effectively urge and maintain the band in an open position.

Accordingly, it is an object of the present invention to provide a band application machine capable of handling small and large diameter bands and bands having depths of various lengths.

Another object of the present invention is to provide a band application machine that consistently applies bands to containers.

Another object of the present invention is to provide a band application machine that can precisely handle a wide range of different size bands and transfer the bands to containers.

Another object of the present invention is to provide a band application machine that is easily adjustable to allow application of a wide range of different size bands without extensive redesigned or reworking of the machine.

Another object of the present invention is to provide a band application machine that is versatile, easy to use, and easy to maintain.

Other objects and advantages of the present invention will become apparent and obvious from a study of the following description and the accompanying drawings which are merely illustrative of such invention.

DETAILED DESCRIPTION OF THE INVENTION

Figure 1:
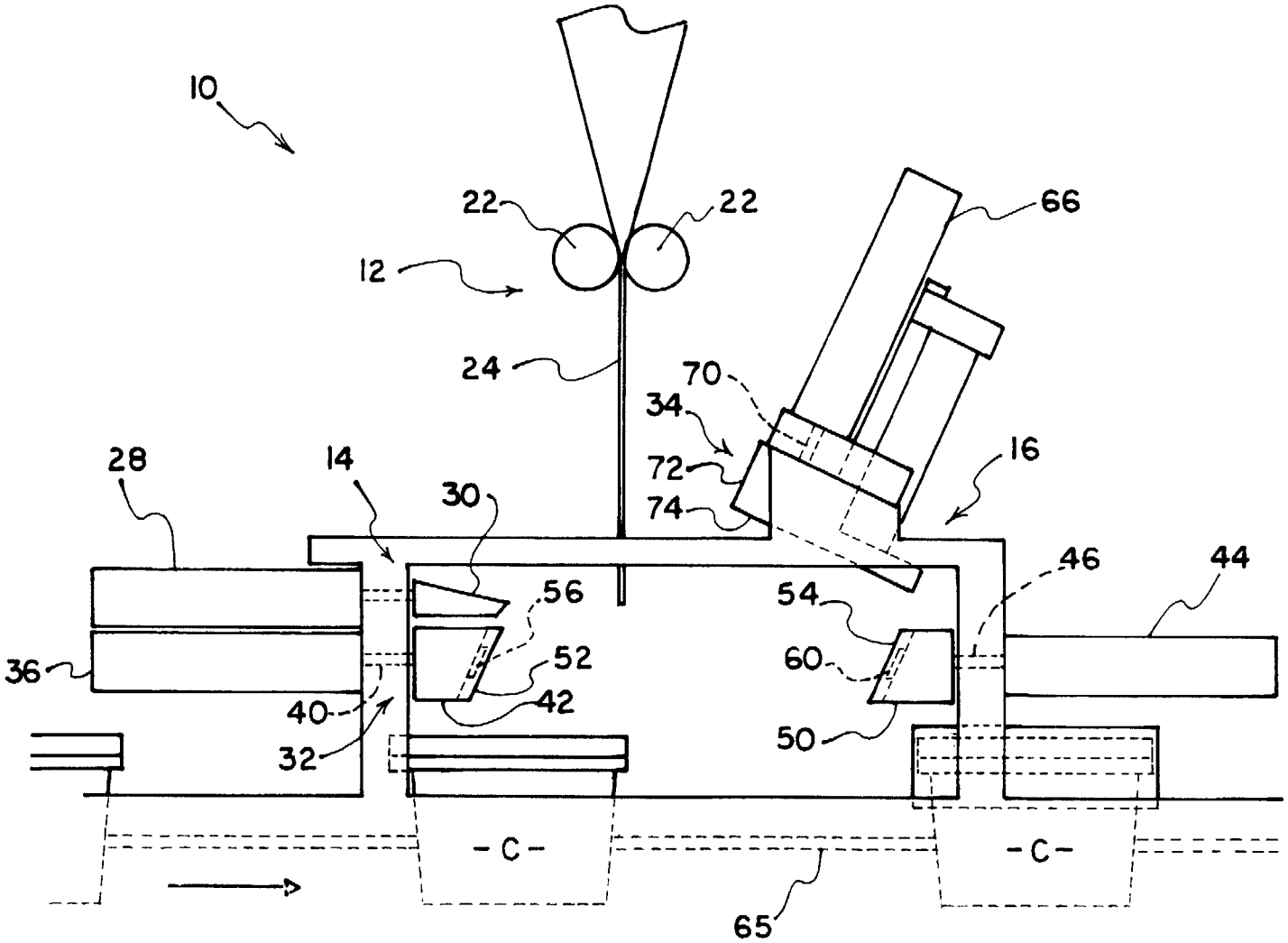
FIGS. 1–5 are a sequence of side views of the band application machine showing the band transfer system applying a band to a container.

The present invention relates to an improved machine for applying heat-shrinkable bands to containers. Machines for applying heat-shrinkable bands are well-known in the prior art and are used throughout the world for applying cut, tamper-evident bands and labels to a wide variety of containers. Therefore, in describing the band application machine of the present invention, it will be appreciated that much of the structure and function of the machine is conventional. For that reason, a detailed description of the entire machine will not be dealt with herein. For a more complete and unified understanding of band application machines and the general state of the art, one is referred to U.S. Pat. Nos. 5,165,215; 4,914,893; 2,623,673; 2,751,735; and 3,802,152; the disclosures of each being expressly incorporated herein by reference.

Now turning to the present invention, it should first be noted that the present invention is directed to a band transfer system of a band application machine, where the band transfer system transfers cut bands from a cutting site to underlying passing containers.

With further reference to the drawings, the machine for applying bands is indicated generally by the numeral 10. Band application machine 10 includes four basic systems, a feed system 12, a cutting system 14, a band transfer system 16, and a control system 20. Briefly viewing each of the systems before proceeding with the detailed description of the invention, it should be pointed out that the feed system 12 functions to direct and advance an elongated, supply strip of band material 24 to the cutting system 14. Cutting system 14 cuts the supply strip 24 into individual cut bands 24a that are ultimately applied to containers. Once cut, each cut band 24a is engaged by the band transfer system 16. Band transfer system 16 functions to grasp the cut band 24a and to position the same for an efficient transfer onto a passing container C. All of the aforementioned systems are connected to and controlled by a conventional control system 20. (See FIG. 7)

Feed system 12 includes a pair of feed rollers 22 and a step motor (not shown) for selectively rotating feed rollers 22. Supply strip 24 is threaded through feed rollers 22 and is gripped therebetween. By rotating feed rollers 22, a selected length of supply strip 24 is fed to cutting system 14.

Cutting system 14 is disposed below feed rollers 22 and functions to cut the supply strip 24 being fed downwardly from feed rollers 22. Cutting system 14 includes a blade 30 that is connected to an air cylinder 28 and is moveable between a retracted position shown in FIG. 1 and an extended position shown in FIG. 2. Blade 30 cuts supply strip 24 to produce a cut band 24a as blade 30 moves from the retracted position to the extended position.

Transfer system 16 functions to grasp the cut band 24a and to effectuate transfer of the cut band 24a onto an underlying, passing container C that is disposed on a conveyor system 65.

Reviewing band transfer system 16 in more detail, the same includes a band-gripping mechanism 32 and a plunger 34. Band gripping mechanism 32 functions to grip and open the cut band 24a, while also laterally positioning the cut band 24a beneath plunger 34. Plunger 34 functions to press the cut band 24a onto passing container C.

Band gripping mechanism 32 includes a first gripper cylinder 36 having a suction-cup block 42 attached to the cylinder's piston 40. Band gripping mechanism 32 also includes a second gripper cylinder 44 which opposes first gripper cylinder 36. Second gripper cylinder 44 also includes a suction-cup block 50 connected to the piston 46 of gripper cylinder 44. Opposing gripper cylinders 36 and 44 each have an angled block face, 52 and 54 respectively. In the preferred embodiment, block faces 52 and 54 are parallel to one another and are disposed at approximately a 25°–30° angle. Block faces 52 and 54 each have a suction cup, 56 and 60 respectively, attached thereto. Suction cups 56 and 60 are connected to a vacuum source (not shown) that draws air through the suction cups 56 and 60 to produce a vacuum securing the cut band 24a to suction cups 56 and 60 when cut band 24a is positioned against suction cups 56 and 60. Once the cut band 24a has been grasped by suction cups 56 and 60, gripper cylinders 36 and 44 are selectively actuated to open cut band 24a and position band 24a beneath plunger 34.

In the preferred embodiment, block faces 52 and 54 each have only a single suction cup 56 and 60 respectively. However, in an alternative embodiment of the present invention, a plurality of spaced suction cups can be provided on each block face 52 and 54 so that the suction cups grasp a band along multiple points on each side of the band. Gripping a cut band with a plurality of suction cups along opposing sides provides more effective handling of large diameter bands or deep bands.

As discussed above and shown in FIGS. 1–5, plunger 34 functions to press cut band 24a, positioned beneath it by gripping mechanism 32, onto a passing container C. In particular, plunger 34 reciprocates between a retracted position shown in FIGS. 1 and 2 to an extended position shown in FIG. 5 where plunger 34 presses cut band 24a onto a passing container C. Plunger 34 includes a plunger cylinder 66 and a plate 72 attached to piston 70 of cylinder 66. As shown in FIG. 6, plate 72 includes a plate face 74 having a pair of elongated channels 76 and an orifice 80 located within each channel 76. Orifices 80 are positioned at an acute angle with respect to the plate face 74 and are connected to a pressurized air source (not shown) that selectively forces an air blast from orifices 80. Channels 76 help direct the air blasts from orifices 80 in a direction downstream of the passing containers C.

Figure 7:
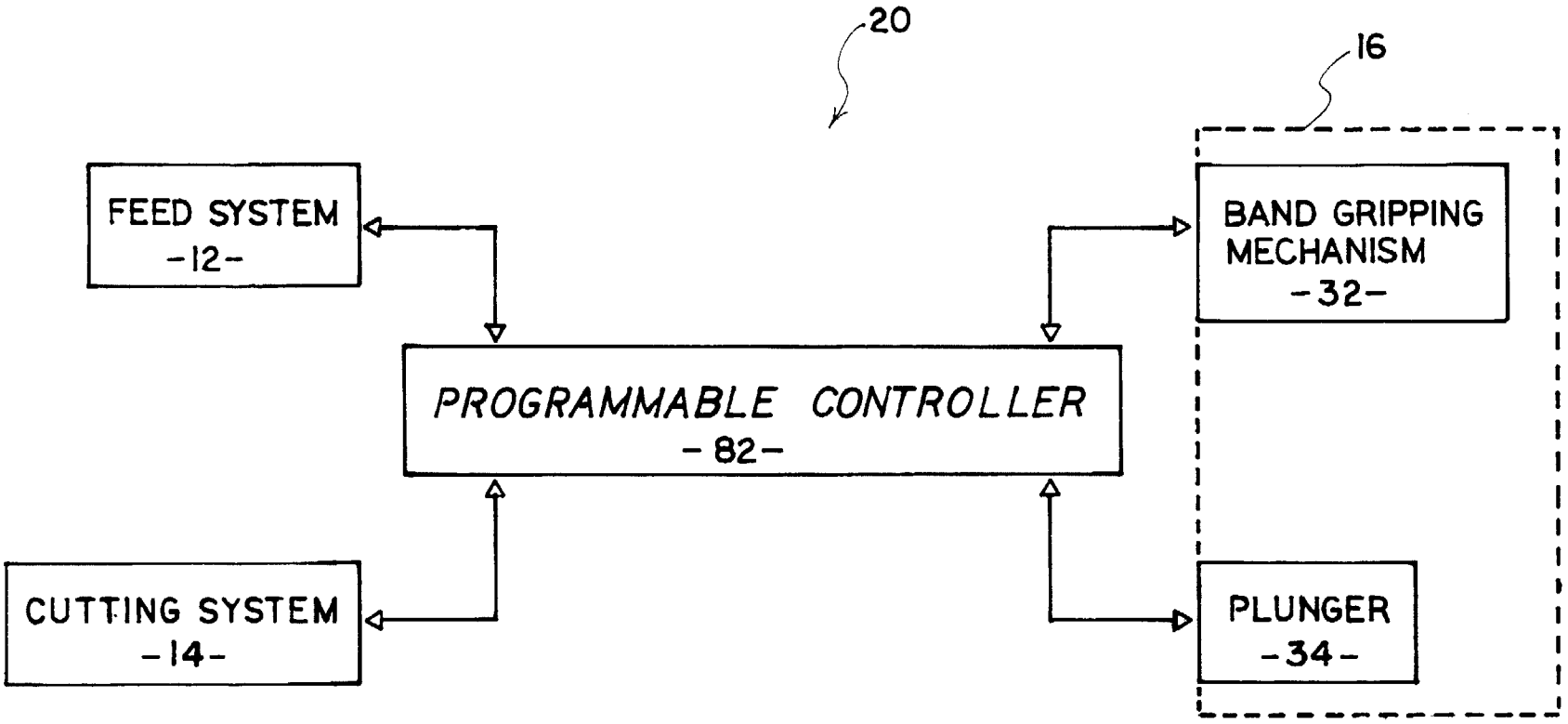
FIG. 7 is a schematic of the control system of the band application machine.

Referring to FIG. 7, it is seen that the central element of control system 20 is a programmable controller 82 connected to the feed mechanism 12, cutting mechanism 14, and transfer system 16. Controller 82 receives input from the various systems and directs the operation of feed system 12, cutting system 14 and transfer system 16. Control system 20 includes various switches connected to controller 82 for sensing selected conditions of the band application machine 10 and signalling programmable controller 82 of these selected conditions. Control system 20 will be described in more detail in the following discussion of the operation of band application machine 10.

Operation of band application machine 10 is controlled by control system 20. Band application machine 10 operates in cycles with each cycle beginning with the feeding of the supply strip 24 and ending with a complete engagement of a cut band 24a with a container C. A description of a single cycle follows.

Figure 2:
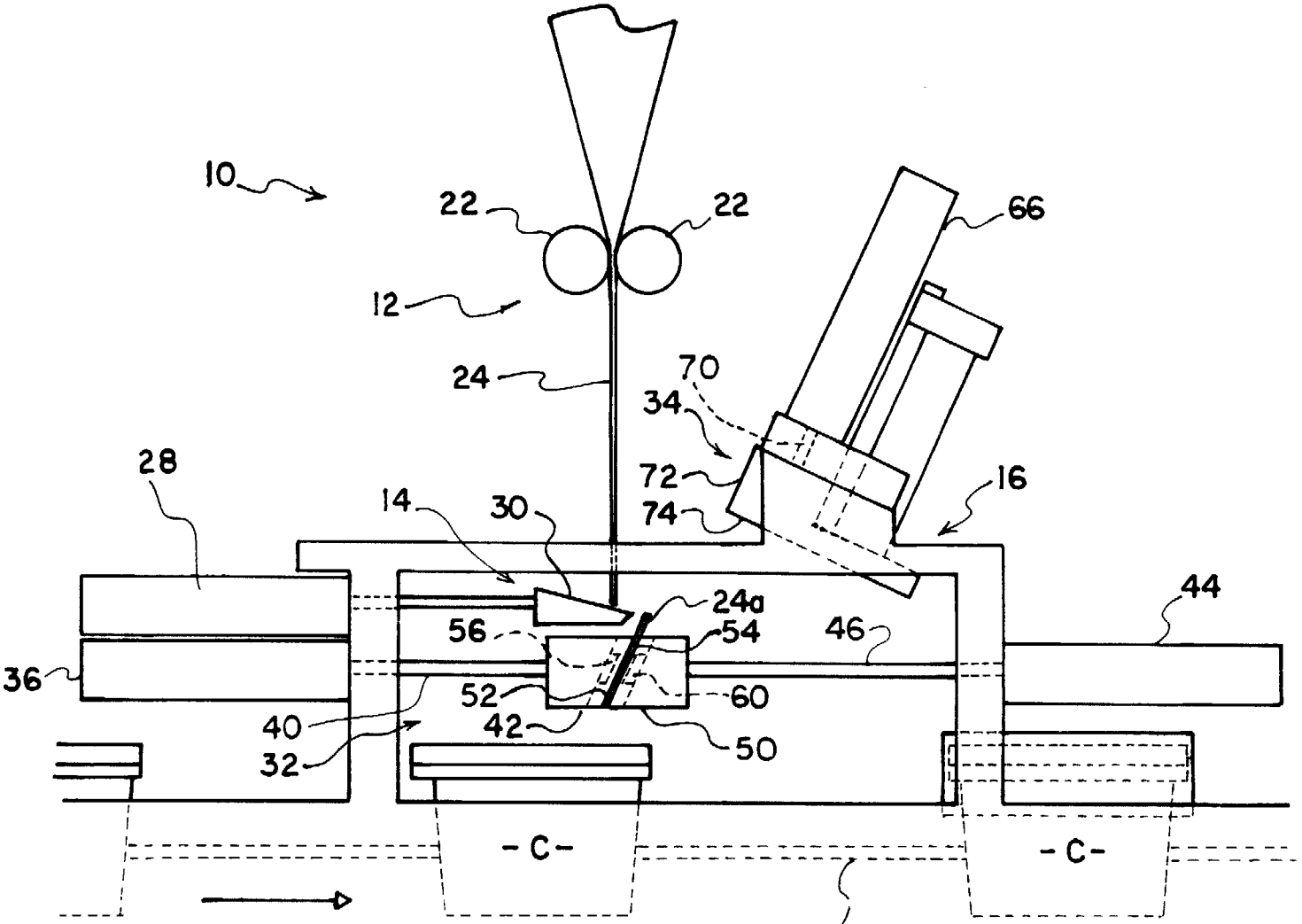

At the beginning of the cycle, band application machine 10 is positioned as shown in FIG. 1. Controller 82 signals the step motor (not shown) attached to rollers 22 to advance supply strip 24 downwardly such that a predetermined length of band material 24 extends below blade 30. Upon advancing supply strip 24 a selected distance, a sensor switch (not shown) associated with feed mechanism 12 signals controller 82 that supply strip 24 has been advanced the selected distance, and in response controller 82 directs the operation of band gripping mechanism 32 as follows. Referring to FIG. 2, gripper cylinder 44 is actuated to place piston 46 in an extended position such that suction-cup block 50 is positioned adjacent a side section of supply strip 24. When gripper cylinder 44 and its piston 46 are placed in the extended position, a sensor switch (not shown) associated with gripper cylinder 44 produces a signal representing this condition and sends this signal to controller 82. Upon receiving this signal, controller 82 directs gripper cylinder 36 to position suction-cup block 42 to a partially-extended position where suction-cup block 42 is positioned adjacent to supply strip 24 and opposing suction-cup block 50.

Upon receiving the signal that the supply strip 24 has been advanced, controller 82 also directs the vacuum source (not shown) to draw air through suction cups 56 and 60. When opposing suction-cup blocks 42 and 50 are positioned adjacent to one another as shown in FIG. 2, a vacuum is produced at suction cups 56 and 60 which causes opposing sides of cut band 24a to be gripped by suction cups 56 and 60.

As gripper cylinder 44 is placed in its extended position, a sensor switch (not shown) associated with gripper cylinder 44 signals controller 82 of this condition. Upon receiving this signal, controller 82 directs cutting mechanism 14 to extend blade 30 from its retracted position (shown in FIG. 1) to its extended position (shown in FIG. 2). As blade 30 is moved to the extended position, it crosses the path of supply strip 24 to produce the cut band 24a. After cutting supply strip 24, blade 30 is moved back into its retracted position.

Figure 3:
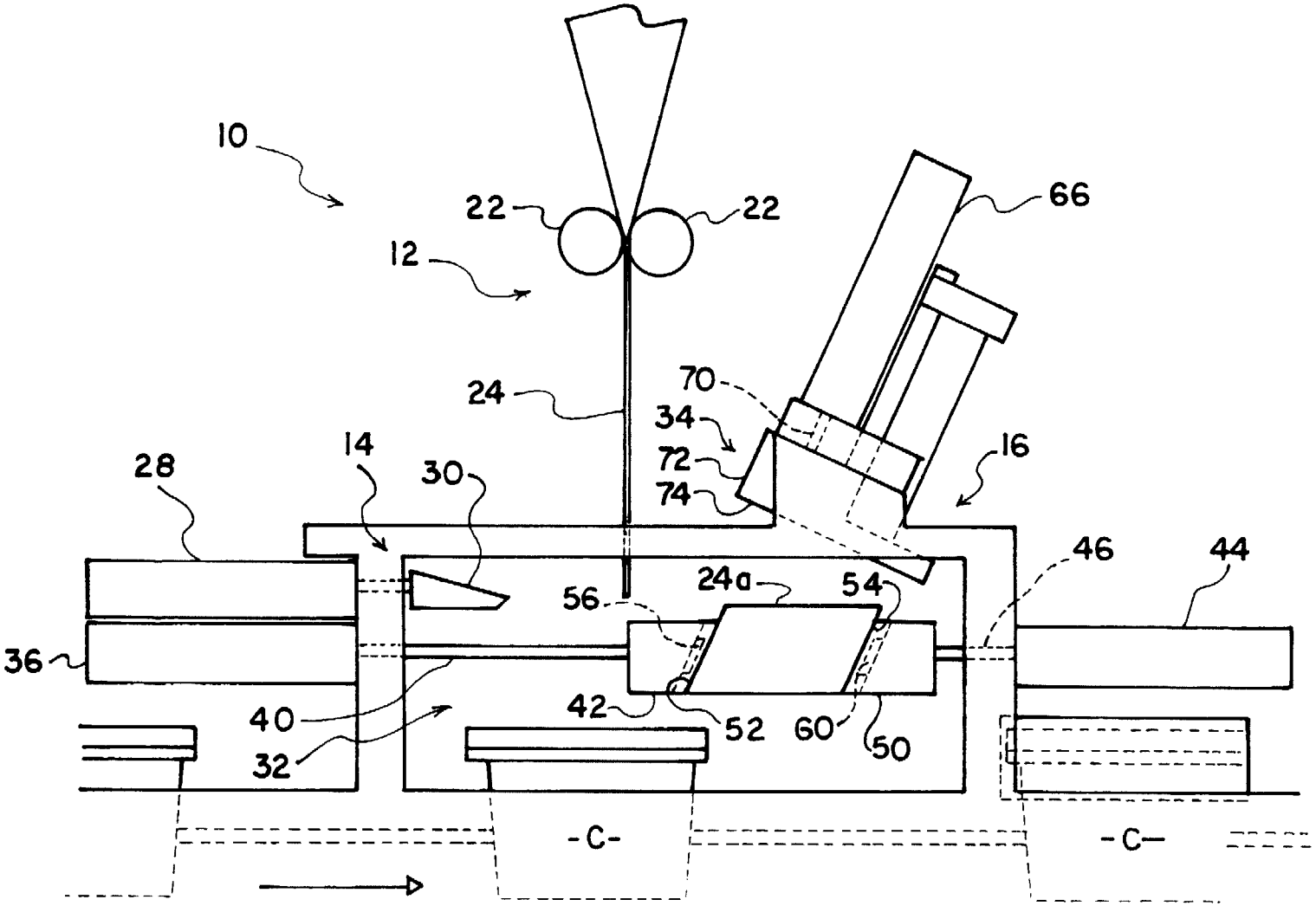

As blade 30 is moved to its extended position, a sensor switch (not shown) associated with cutting mechanism 14 signals controller 82 of this condition. Upon receiving this signal, controller 82 directs gripper cylinder 44 to move suction-cup block 50 into a retracted position which also directs gripper cylinder 36 to move suction-cup block 42 to a fully extended position. As shown in FIG. 3, as gripper cylinder 44 is moved into its retracted position and gripper cylinder 36 is positioned to its fully extended position, cut band 24*a* which is gripped between block faces 52 and 54 is moved from a closed position into an open position. In addition, band 24*a* is laterally moved from a cutting and band supply area to a location beneath plunger 34. The lateral movement of band 24*a* is necessary to provide clearance for plunger 34 such that the stroke of plunger 34 is not hindered by cutting system 14 or feed system 12.

A sensor switch (not shown) associated with gripper cylinder 36 signals controller 82 when gripper cylinder 36 is moved into its fully extended position. Upon receiving this signal, controller 82 directs the vacuum source (not shown) to release the vacuum at suction cups 56 and 60 such that cut band 24*a* is released from band gripper mechanism 32. After the vacuum is released, opposing gripper cylinders 36 and 44 are directed to move into their initial retracted positions.

Figure 4:
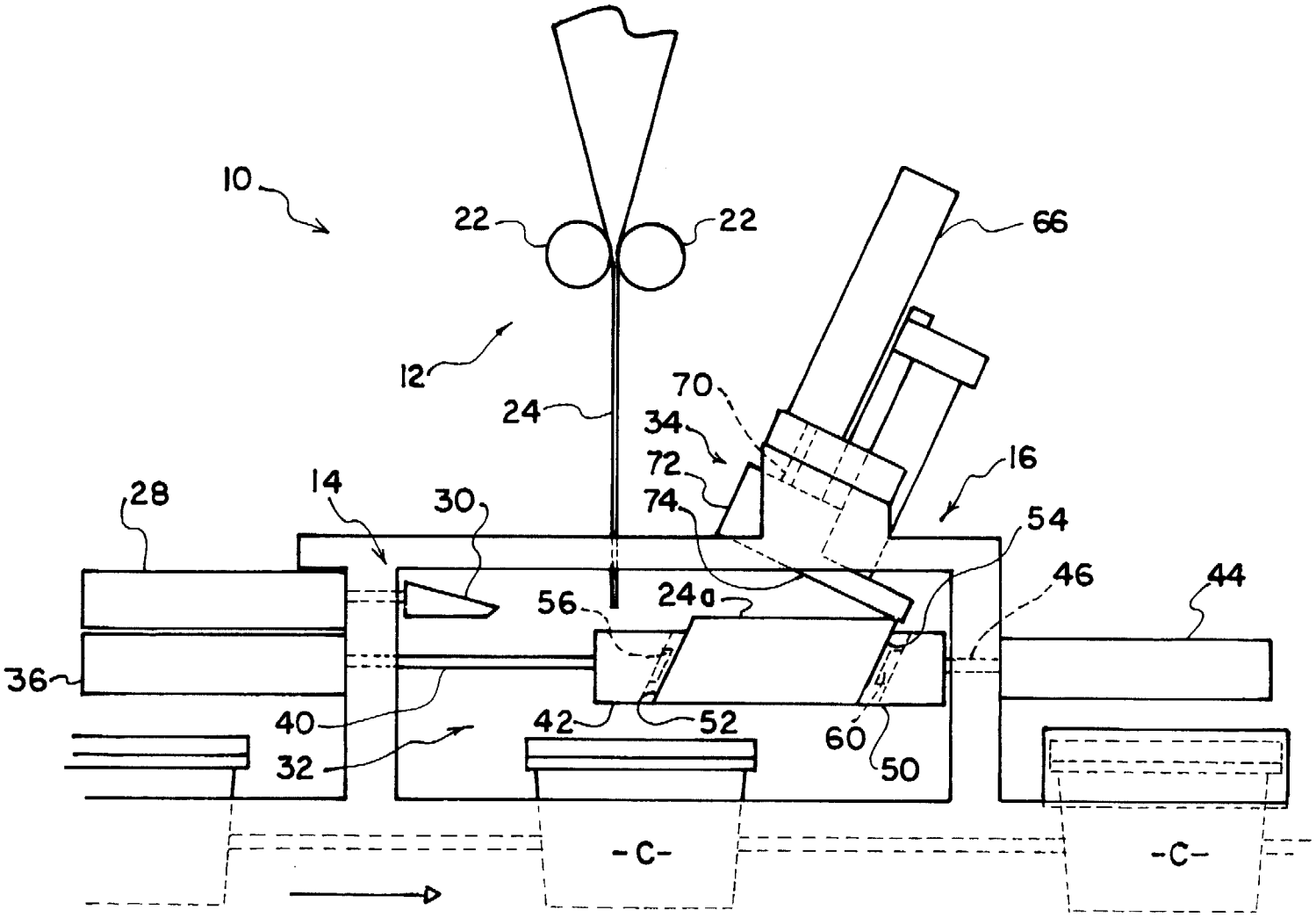

At approximately the same time that band 24*a* is released, plunger 34 is signaled to move to the extended position by a sensor switch which (not shown) is associated with conveyor system 65 and which indicates the position of container C on conveyor 65. The path of plunger 34 is aligned with the cut band 24*a* such that the band 24*a* is pressed onto container C passing below. As plate 72 moves from the retracted position to the extended position, as shown in FIG. 4, angled face 74 initially contacts the leading edge of cut band 24*a*. Band 24*a* is then pushed into an angled position corresponding to the angle of plate face 74.

Figure 5:
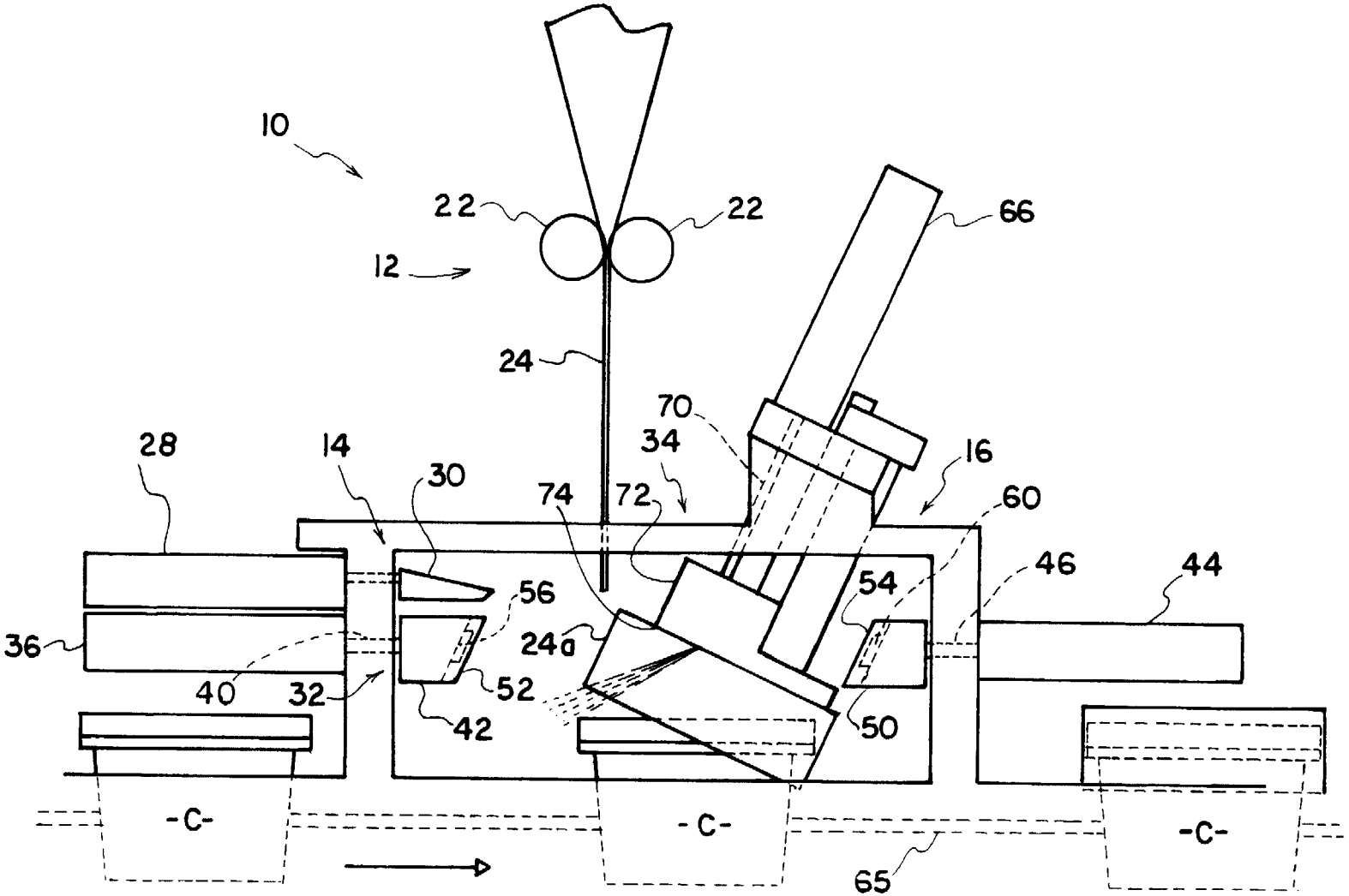
Figure 6:
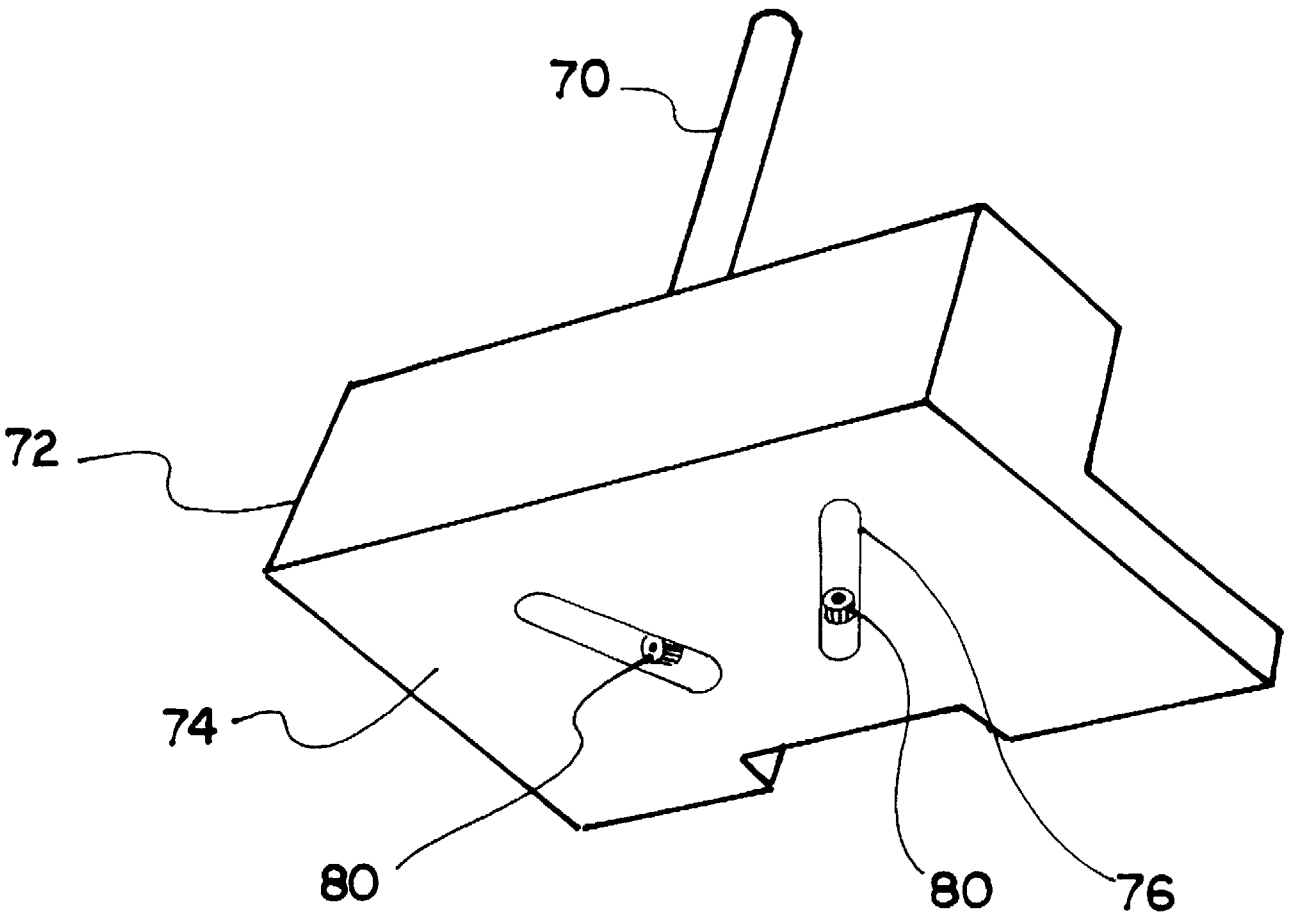
FIG. 6 is a perspective view of the plunger of the band application machine showing the plunger's air blast orifices.

As plate 72 is moved from the retracted position to the extended position, as shown in FIG. 5, the pressurized air source (not shown) also directs a blast of air through orifices 80. The blast of air is directed downwardly against an inside, trailing-edge section of cut band 24*a*. The blast of air helps force and maintain the trailing-edge section of band 24*a* in an open position to help ensure that cut band 24*a* remains in an open position and is properly positioned over container C as the plunger 34 presses cut band 24*a* onto container C. If the cut band 24*a* is not positioned properly over a container C or is inadvertently moved toward a closed position, cut band 24*a* may be pressed against the top of passing container C and not be pressed over and onto container C. The blast of air from orifices 80 helps ensure that cut band 24*a* is maintained in the open position and properly positioned. In addition, the blast of air helps ensure that the trailing edge of band 24*a* is not snagged on imperfections or irregularities on the surface of the top of container C.

Figure 5C:
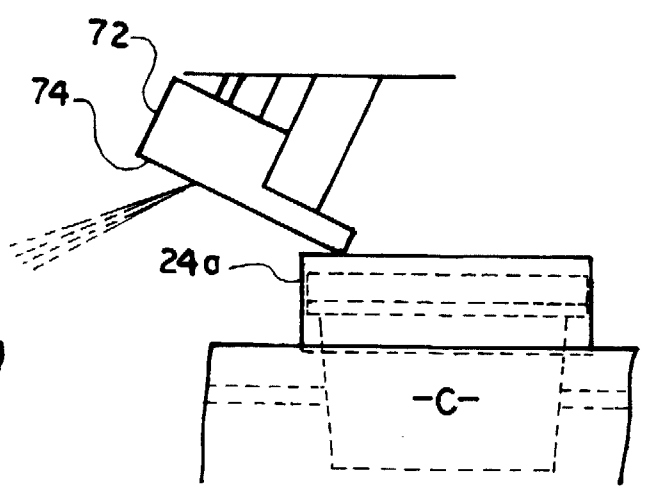
Figure 5B:
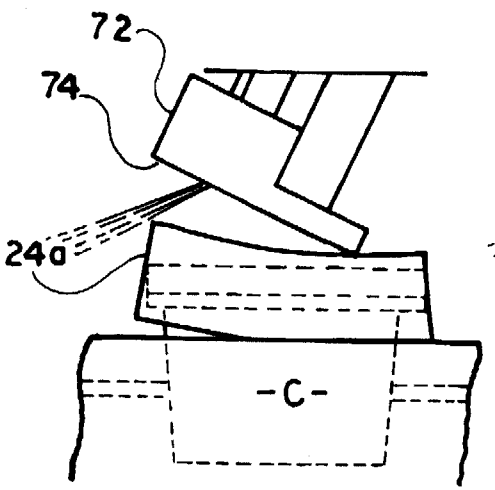
Figure 5A:
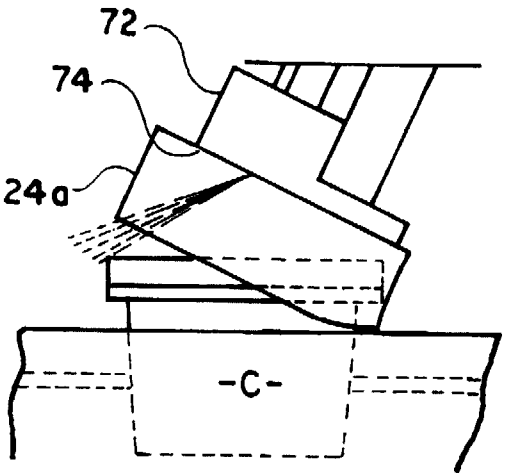

The timing of plunger 34 is also adjustable to ensure that cut band 24*a* is properly pressed onto a passing container C. For large diameter bands 24*a* and corresponding large containers C, controller 82 is programmable such that plunger 34 is maintained in its extended position for a relatively extended time period such that cut band 24*a* is gradually pressed onto a container C. See FIGS. 5A–5C. Due to the large size of a band 24*a* corresponding to a large diameter container C, such a band 24*a* cannot be fully punched onto the container C as plunger 34 initially reaches its extended position. Instead, the plunger 34 is held in its extended position so that the band 24*a* is gradually pressed onto container C as container C advances beneath plunger 34. In contrast, for smaller diameter bands 24*a* and corresponding smaller containers C, bands 24*a* can be fully punched onto a container C as plunger 34 initially reaches its extended position. Accordingly, for small diameter bands controller 82 is programmed such that plunger 34 stays in an extended position only momentarily. This is accomplished by a simple punching action. Once cut band 24*a* has been fully pressed onto a container C, plate 72 of plunger 34 is re-positioned into its initial, retracted position. The band application cycle is completed and ready for a subsequent cycle once plunger 34 is moved to the retracted position.

The band application machine 10 of the present invention provides a band transfer system 16 that enables a cut band 24*a* to be more effectively gripped, positioned, and placed onto a passing container C. Band transfer system 16 and controller 82 enables band application machine 10 to handle both small and large diameter bands and bands having depths of various lengths, without the need for extensive redesigning or reworking the band application machine 10 to accommodate different-sized bands. Band application machine 10 is also easily adjustable to allow consistent and precise application of different-sized bands.

The present invention may, of course, may be carried out in other specific ways than those herein set forth without departing from the spirit and essential characteristics of the invention. The present embodiments are, therefore, to be considered in all respects as illustrative and not restrictive and all changes coming within the meaning and equivalency range of the appended claims are intended to be embraced therein.

What is claimed is:

1. A method of applying a band to a container conveyed passed a band application machine, comprising:

(a) cutting a band from a supply strip;

(b) gripping opposite sides of the cut band with a gripping mechanism and pulling the opposite sides of the band to an open position;

(c) moving a plunger spaced above the open cut band at a position above the container downwardly toward the cut band;

(d) releasing the cut band from the gripping mechanism at a position above the container and engaging the cut band with the downwardly moving plunger; and (e) pushing the cut band downwardly with the plunger past the gripping mechanism onto the passing container.

2. The method of claim 1 wherein the step of gripping opposite sides of the cut band includes engaging the opposite sides of the cut band with suction cups and spreading the suction cups to cause the cut band to assume the open position.

3. The method of claim 1 wherein the step of releasing the cut band from the gripping mechanism occurs at approximately the same time that the plunger begins to move downwardly towards the cut band.

4. The method of claim 1 wherein the cut band includes a downstream leading edge and wherein the method further includes the step of engaging the leading edge of an underlying band with the plunger as the plunger moves into engagement with the cut band.

5. The method of claim 1 further including the step of directing an air blast against an inside section of the open band as the plunger acts to transfer the open band to a container.

6. The method of claim 1 further including the step of directing an air blast from the plunger against an inside, trailing portion of the cut band as the plunger moves downwardly and engages the cut band.

7. The method of claim 1 further including the step of laterally moving the cut band from a position laterally spaced from the plunger to a position where the band is open and aligned with the stroke of the plunger.

8. A method of applying bands to containers conveyed past the band application machine, comprising:

(a) cutting a band from a supply strip;

(b) opening the band;

(c) engaging opposite sides of the band and holding the band in an open configuration above the containers being conveyed and wherein at least one side of the band is held by a suction cup while the band is supported above the containers;

(d) releasing the held cut band at a position above the containers;

(e) moving a plunger mounted above a cut band back and forth between a retracted position where the plunger is spaced above the cut band to an engaged position where the plunger actually engages the top of the cut band; and (f) transferring the open cut band held above the containers onto an underpassing target container by moving the plunger downwardly from the retracted position and engaging the top of the band while the band is above the target container and pushing band downwardly onto the target container.

9. The method of claim 8 including the step of directing an air blast from the plunger against a portion of an inside wall of the cut band as the plunger moves downwardly so as to generally maintain the cut band in an open position thereby assisting the plunger in applying the cut band to an underpassing container.

10. The method of claim 8 further including the step of positioning the plunger at an angle with respect to the underlying band and driving the plunger downwardly and initially engaging a leading edge of the cut band.

11. The method of claim 8 further including the step of laterally moving the entire cut band from a position laterally spaced from the plunger to a position where the band is open and aligned with the stroke of the plunger.

12. The method of claim 1 wherein the step of moving the plunger downwardly towards the cut band includes passing the plunger between two opposed and spaced apart band gripping devices as the plunger engages the cut band and pushes the cut band downwardly onto the passing container, whereby the plunger reciprocates generally up and down between the opposed band gripping devices.

13. In a band application machine, a transfer mechanism for applying a band to a container conveyed past the band application machine, comprising:

(a) opposed vacuum operated suction cups for gripping opposite sides of a band and pulling the opposite sides of the band to an open position;

(b) a plunger movably mounted above the suction cups and moveable between a retracted position spaced from the open band to an engaged position where the plunger actually engages the top of the band and pushes the same downwardly onto a passing container; and (c) a controller for effectively releasing the vacuum on the suction cups while the band is held in an open position above the container and for actuating the plunger and causing the same to move from the retracted position to the engaged position where the plunger engages the open band above the container and pushes the same downwardly onto and around the top portion of the container.

14. The invention of claim 13 wherein the controller releases the vacuum associated with the suction cups at approximately the same time as the plunger is actuated to move from the retracted position to the engaged position such that the suction cups and plunger effectively cooperate to transfer the band to a passing container.

15. The invention of claim 13 wherein the plunger has a face disposed at an angle with respect to the underlying band such that the face engages a leading edge of the underlying band as the plunger moves into the engaged position.

16. The invention of claim 15 wherein the plunger is operative to direct an air blast against an inside section of the open band for effectively maintaining the band open.

17. The invention of claim 16 wherein the air blast is directed from the face of the plunger.

18. The invention of claim 17 wherein the suction cups include opposing faces angled generally normal with respect to the angled plunger face, and wherein the suction cups are disposed on opposite sides of the band when in the open position.

19. The invention of claim 13 including means for laterally moving the opposed suction cups from a position where the band is closed to a position where the band is open and aligned with the stroke of the plunger.

20. In a band application machine, a transfer mechanism for applying cut bands to containers conveyed past the band application machine, comprising: a holding mechanism, including at least one suction cup, for engaging opposite sides of an open cut band and holding the open cut band in a position above the containers being conveyed past the band application machine and for releasing the held band at a position above the containers; and a plunger movably mounted above the cut band and moveable between a retracted position spaced from the cut band to an engaged position where the plunger actually engages the top of the cut band, while the band is still disposed above the containers, and pushes the same downwardly onto a passing container.

21. The band application machine of claim 20 wherein the plunger is operative to direct a blast of air against a portion of an inside wall of a cut band as the plunger moves downwardly so as to urge the cut band towards an open position thereby assisting the plunger in applying the cut band to an underpassing container.

22. The invention of claim 21 wherein the plunger includes a face having at least one air orifice formed therein through which the blast of air is directed.

23. The invention of claim 20 wherein the face of the plunger is disposed at an angle with respect to the underlying band such that the face of the plunger initially engages a leading edge of the cut band as the plunger moves from the retracted position to the engaged position.

24. The invention of claim 23 wherein the transfer mechanism includes opposed suction cups for gripping opposite sides of the cut band and pulling the opposite sides to an open position, the suction cups including a pair of opposing block faces positioned at an angle generally normal with respect to the plunger face, each block face having at least one suction cup attached thereto.

25. The invention of claim 24 including means for laterally moving the opposed suction cups from an initial position where the opposed suction cups grip a closed band positioned adjacent the plunger to a underlying position where the band is in an open position and aligned with the stroke of the plunger.

26. The invention of claim 22 wherein the orifice is positioned in the face of the plunger so as to direct the blast of air against a trailing portion of the cut band.

27. The method of claim 9 including the step of directing the air blast against a trailing portion of the cut band.

* * * * *